US006818274B1

(12) United States Patent
Buck et al.

(10) Patent No.: US 6,818,274 B1
(45) Date of Patent: Nov. 16, 2004

(54) ARTIFICIAL TURF SYSTEM USING SUPPORT MATERIAL FOR INFILL LAYER

(75) Inventors: Mark E. Buck, Enumclaw, WA (US); Ronald C. Linn, Moon Township, PA (US)

(73) Assignee: Bright Intellectual Asset Management, LLC, Herndon, VA (US)

( * ) Notice: Subject to any disclaimer, the term of this patent is extended or adjusted under 35 U.S.C. 154(b) by 0 days.

(21) Appl. No.: 10/345,177

(22) Filed: Jan. 16, 2003

(51) Int. Cl.[7] ..... A41G 1/00

(52) U.S. Cl. ..... 428/87; 428/17; 428/143; 428/149; 428/150; 428/402

(58) Field of Search ..... 428/17, 15, 85, 428/87, 143, 149, 150, 402; 405/36

(56) References Cited

U.S. PATENT DOCUMENTS

| | | | | | |
|---|---|---|---|---|---|
| 4,337,283 | A | | 6/1982 | Haas | |
| 4,396,653 | A | * | 8/1983 | Tomarin | 428/17 |
| 5,958,527 | A | | 9/1999 | Prevost | |
| 5,976,645 | A | * | 11/1999 | Daluise et al. | 428/17 |
| 6,070,824 | A | | 6/2000 | DuPont | |
| 6,242,062 | B1 | | 6/2001 | deVries | |
| 6,299,959 | B1 | | 10/2001 | Squires et al. | |
| 6,338,885 | B1 | | 1/2002 | Prevost | |
| 6,372,310 | B2 | | 4/2002 | deVries | |
| 6,432,505 | B1 | | 8/2002 | Sweenie et al. | |
| 6,551,689 | B1 | * | 4/2003 | Prevost | 428/143 |
| 2002/0048676 | A1 | * | 4/2002 | McDaniel et al. | 428/404 |
| 2002/0132099 | A1 | | 9/2002 | Squires | |
| 2003/0056432 | A1 | * | 3/2003 | Prevost | 47/1.01 F |

OTHER PUBLICATIONS

Petro ware, Inc. , Saddles and Rings (2 pages), Jan. 10, 2003.
Ceramics, Ceramics Overview, Jan. 10, 2003 (4 pages).
Refineries—Hydrogen Plant Products—Support Materials, Dec. 30, 2002 (2 pages).
Dycat ICB Alumino–Silicate Ceramic support (1 page).
Katalco Dypac 99 High Density Pure Alumina Packing Media (1 page).
Sportfield's Gauge Impact Layer, Dec. 16, 2002 (1 page).
BP—Fabrics and Fibers—Carpet Backings, Jan. 10, 2003 (3 pages).
Recycled Cross–Link Closed Cell Polyethylene Foam, Sirex Engineering, Dec. 21, 2002 (5 pages).

* cited by examiner

*Primary Examiner*—John J. Zimmerman
*Assistant Examiner*—Wendy Boss
(74) *Attorney, Agent, or Firm*—R. Edward Brake

(57) ABSTRACT

An infill layer for use in an artificial turf system is provided. The artificial turf system may include a pile fabric having a turf backing and a plurality of turf fibers extending upwardly from the turf backing. The infill layer may include particulate material disposed upon an upper surface of the turf backing and between the turf fibers. The infill layer may advantageously comprise ceramic support material in one or more courses. The ceramic support material may also be combined with other hard particles and/or with resilient particles in the infill layer. Alternatively, recycled support material or support material having a substantially consistent size and shape may be used instead of ceramic support material.

15 Claims, 6 Drawing Sheets

100

100

527

627

ARTIFICIAL TURF SYSTEM USING SUPPORT MATERIAL FOR INFILL LAYER

FIELD OF THE INVENTION

One or more embodiments are directed to an artificial turf system that uses support material for an infill layer.

BACKGROUND INFORMATION

Natural grass turf has been traditionally used for athletic events. However, natural grass typically does not grow well within shaded areas or enclosed stadiums. Also, high traffic areas on natural grass wear out rapidly creating muddy or dusty areas on the field.

Artificial turf is commonly used on athletic fields instead of natural grass turf. Artificial (or synthetic) turf was developed to mimic the look and feel of natural grass. However, artificial turf is generally more durable and less expensive to maintain than natural grass.

Artificial turf generally involves a carpet-like pile fabric having a backing laid on a compacted substrate, such as small stones or rocks or other stabilized base material. The pile fabric has rows of upstanding turf fibers or synthetic ribbons representing grass blades extending upwardly from the backing. The backing typically includes small holes or perforations to allow water to drain through the turf.

Various formulations of infill have been interspersed among the turf fibers on the backing to simulate the presence of soil. Most types of infill have used various combinations of sand, small rocks and resilient particles. For example, U.S. Pat. No. 4,337,283 discloses an artificial turf having a pile fabric, and a top-dressing layer comprising a mixture of from 25 to 95 volume percent resilient particles such as rubber, and from 5 to 75 percent volume sand. This top-dressing layer is interspersed among the pile elements or turf fibers on the backing. The top-dressing layer may operate to stabilize or prevent movement of the turf, to absorb shock and impact of players, and to improve footing. As another example, U.S. Pat. No. 5,958,527 discloses an artificial turf having an infill with several layers, including a base course of sand and/or small rocks and a top course of resilient particles.

There are several potential problems with the use of sand and rocks in an infill layer. Sand and rocks can be abrasive and/or have rough edges, which may damage the turf fibers and backing. In addition, sand or small particles can become lodged in backing perforations, which can prevent proper drainage of water from the turf. This may cause water to accumulate on the turf and resilient particles in the infill to float during rainfall. The use of an infill layer of sand and/or rocks, typically having uneven sizes and shapes, creates unpredictable drainage characteristics. Sand and rocks in a turf infill may also absorb body fluids (such as blood) and other contaminants, and therefore, may

BRIEF DESCRIPTION OF THE DRAWINGS

The subject matter regarded as embodiments of the invention is particularly pointed out and distinctly claimed in the concluding portion of the specification. Embodiments of the invention, however, both as to organization and method of operation, together with objects, features, and advantages thereof, may best be understood by reference to the following detailed description when read with the accompanying drawings in which:

DETAILED DESCRIPTION

In the following detailed description, numerous specific details are set forth in order to provide a thorough understanding of the embodiments of the invention. It will be understood by those skilled in the art, however, that embodiments of the invention may be practiced without these specific details. In other instances, well-known methods, procedures and techniques have not been described in detail so as not to obscure the foregoing embodiments.

It is worthy to note that any reference in the specification to "one embodiment" or "an embodiment" means in this context that a particular feature, structure, or characteristic described in connection with the embodiment may be included in at least one embodiment of the invention. The appearances of the phrase "in one embodiment" or "an embodiment" in various places in the specification do not necessarily refer to the same embodiment, but may be referring to different embodiments.

Described are various embodiment of an artificial turf system. The artificial turf system may include a pile fabric having a turf backing and a plurality of turf fibers extending upwardly from the turf backing. The artificial turf system may include an infill layer. The infill layer may include particulate material disposed upon an upper surface of the turf backing and between the turf fibers. The infill layer may advantageously comprise ceramic support material in one or more courses or layers. The ceramic support material may also be combined with other hard particles and/or with resilient particles in the infill layer. The ceramic support material may be used in a variety of shapes and sizes. Alternatively, recycled support material or support material having a substantially consistent size and shape may be used instead of ceramic support material.

According to an embodiment, the ceramic support material used in an infill layer may offer a number of advantages over sand, rocks, stone and other conventional hard particles presently used in infill layers. For example, ceramic support material may be substantially consistent in: size, shape, porosity, hardness, composition, density, crush strength, etc. The ceramic support material, having a known consistent size and shape may provide improved drainage because of consistent void spaces between particles.

Figure 1:
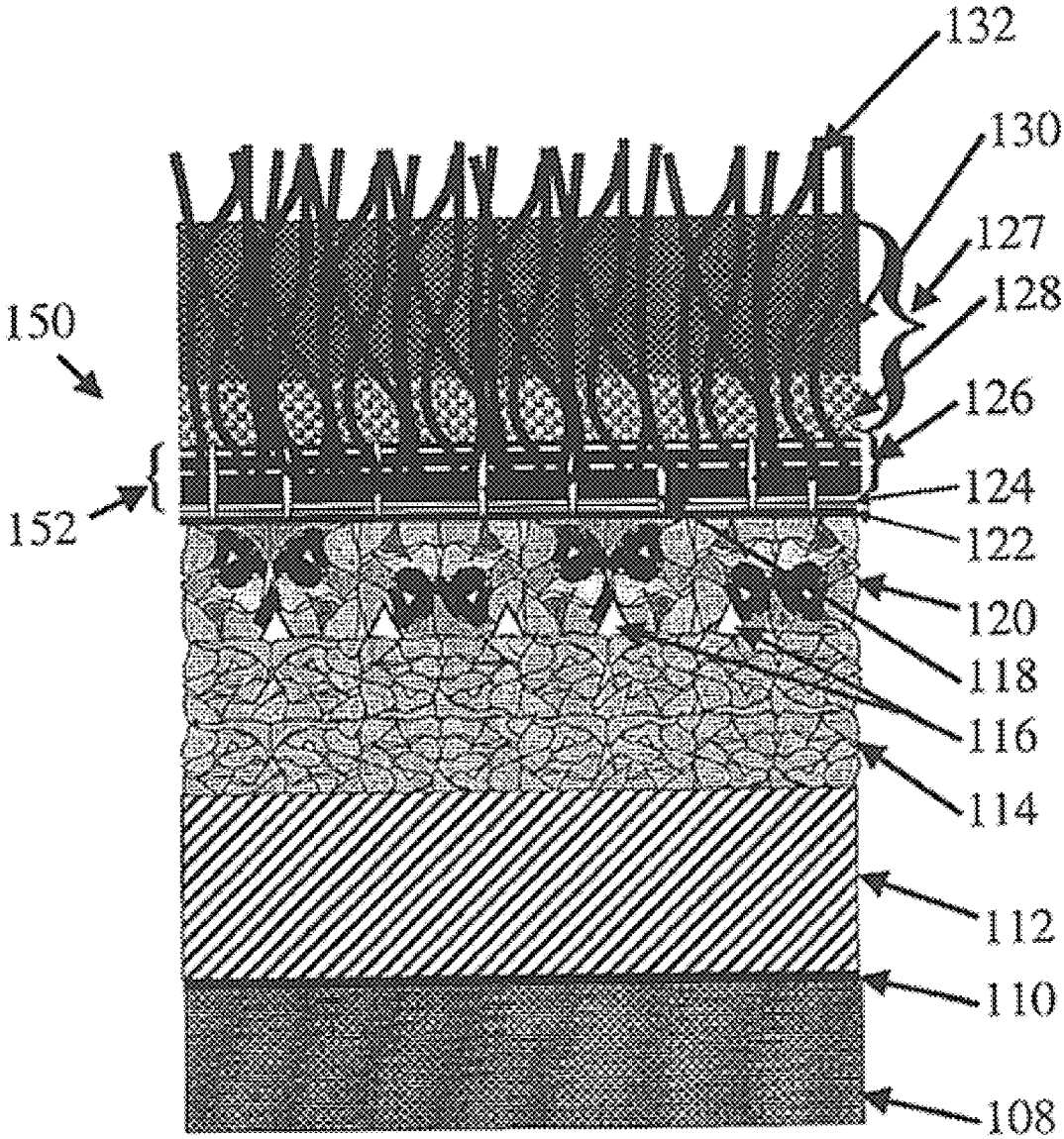
FIG. 1 is a cross-sectional view of an artificial turf system in accordance with an example embodiment.

Referring to the Figures in which like numerals indicate like elements, FIG. 1 is a cross-sectional view of an artificial turf system 100 in accordance with an example embodiment. Referring to FIG. 1, a sloped sub-surface base layer 108 is provided. Sub-surface base layer 108 may be formed, for example, by removing turf, etc. and grading and compacting the earth. Excavation of materials may be necessary to establish a proper grade of sub-base to a slope from about 0.5% to about 1%, as an example, from the field centerline to facilitate proper drainage. Sub-surface base layer may be compacted to about 95% Proctor density, if possible, to provide a firm and stable surface. An optional non-porous geotextile layer 110 may be provided on sub-surface base layer 108 to prevent erosion of sub-surface base layer 108.

An open graded aggregate layer 112 may be disposed over layer 108 or layer 110. Aggregate layer 112 may be comprised of crushed rock or stone to allow water to drain through layer 112. In one example embodiment, aggregate layer 112 may have a thickness of about 6 inches. Suitable open graded aggregate may also be, for example, a combination of stone and sand. The aggregate layer should preferably be installed so as to maintain a grade slope of 0.5% to 1% from the field centerline, for example. Aggregate layer 112 may be compacted to about 95% proctor density to provide a firm and stable surface.

An optional firm substrate pad 114 may be disposed over aggregate layer 112. Firm substrate pad 114 may be formed from rubber, plastic, polyethylene foam or other suitable material. In an example embodiment, firm substrate pad 114 may be porous and have a thickness of about 0.125 inches up to 8 inches, for example. In an embodiment, firm substrate pad may have a thickness of about one inch up to about four inches. According to an example embodiment, firm substrate pad 114 may be formed from a high-density, recycled, cross-ink, closed cell polyethylene foam sheets or panels. Such recycled closed cell polyethylene foam panels may be available, for example, from Sirex Engineering, Ontario, Canada, for example under the product names "3R Foam" or"3RHD Foam."

According to an example embodiment, firm substrate pad may be used to eliminate all or part of aggregate layer 112. Forming aggregate layer 112 can be an expensive process. By using a high-density firm substrate pad 114, which may provide a firm and stable surface, all or part of aggregate layer 112 may be eliminated in this process.

Next, a shock attenuating pad 120 is provided over firm substrate pad 114 (or over aggregate layer 112). Shock attenuating pad 120 may advantageously be a porous pad formed from a resilient material such as rubber, polyethylene, or other suitable resilient material to attenuate shock, provide cushioning and/or absorb impact. According to an example embodiment, shock attenuating pad 120 may have a thickness from about 1/18 inch to about 2 inches, for example. Shock attenuating pad may advantageously be approximately 3/8 inch to 5/8 inch thick, and may preferably be 1/2 inch thick, for example.

According to an example embodiment, shock attenuating pad 120 may be recycled closed cell polyethylene foam sheets or panels. Such recycled polyethylene foam sheets or panels for shock attenuating pad may also be obtained from Sirex Engineering.

According to an example embodiment, shock attenuating pad 120 may be a channeled shock attenuating pad, since pad 120 may include one or more drainage channels 116 formed, for example, in a lower surface of shock attenuating pad 120. By providing a space or void, drainage channels 116 may allow water to drain or flow substantially in a horizontal direction away from the field centerline toward a perimeter of the field, for example. Thus, it can be seen, that with drainage channels 116 in shock attenuating pad 120, water may be allowed to drain both vertically (e.g., through pads 120 and 114 and layer 112) and vertically (e.g., under channels 116 from the field centerline to the field perimeter). Such a foam pad with channels may be available from Sirex Engineering, although it is believed that such foam pads with drainage channels have not previously been used for artificial turf systems.

Therefore, according to an example embodiment, shock attenuating pad 120 may be considered to be a channeled shock/drainage pad since it may perform two functions: 1) providing cushioning and shock absorption (due to its resilient properties), and 2) promoting or facilitating drainage for the artificial turf system 100 through the use of drainage channels 116 formed in the pad.

According to an example embodiment, drainage channels 116 may be formed, molded, etched, ground or otherwise provided within shock attenuating pad 120. In FIG. 1, drainage channels 116 are shown as being substantially triangular in shape. However, drainage channels 116 may be rounded or oval shaped, rectangular shaped, or any other appropriate shape.

A nonwoven porous geotextile layer 122 may be situated over shock attenuating pad 120. Geotextile layer 122 may be, for example, a geotextile membrane made from a needle-punched polypropylene, such as Amoco 4545 available from Amoco. Geotextile layer 122 is preferably permeable to water to allow water to drain or pass through, but may prevent movement of one layer into another layer.

A carpet-like pile fabric 150 may be provided or laid over geotextile layer 122 (or provided over pad 120 if geotextile layer 122 is omitted). Pile Fabric 150 may include a turf backing 152 at the lower end of pile fabric 150. Turf backing 152 may be laid on geotextile layer 122. The pile fabric 150 also includes a plurality of rows of upstanding turf fibers 132 that are tufted through (or otherwise connected to) turf backing 152. Turf fibers 132 extend upwardly from an upper surface of the turf backing 152. Turf fibers 132 may be made from polyethylene, polypropylene, a polyethylene/polypropylene blend, for example, or other suitable material. The turf fibers 132 may be approximately 2–3 inches in height, for example. In one embodiment, turf fibers 132 may extend. approximately 2–2.5 inches above turf backing 152.

In an example embodiment, the turf backing 152 is flexible and provides weight, and dimensional integrity and stability for pile fabric 150. Turf backing 152 may be formed from a variety of well-known materials. According to an embodiment, turf backing 152 may include a primary backing 126 and a secondary backing 124. Primary backing 126 may be disposed on or above the secondary backing 124.

Primary backing 126 may be a single layer or a multi-layered backing, and may include woven and/or non-woven backing layers. In an example embodiment, primary backing 126 may include a non-woven backing layer and a woven backing layer bound together or bonded together. The non-woven backing layer may be a spun bound, polyester/nylon blend material, for example. The woven backing layer may be a woven material known in the art as "FLW" which includes a layer of felt.

Secondary backing 124 may be, for example, a liquid-applied secondary backing such as urethane or styrene butadiene often used in carpet coating processes. Secondary backing 124 may be applied to the primary backing 126 by spray coating or other technique, and helps bond the turf fibers to the backing, and adds strength, weight and integrity to the turf backing. In one embodiment, the liquid-applied secondary backing 124 may be absorbed by the nylon/polymer non-woven backing layer and/or by the felt of the FLW woven backing layer. The turf backing 152 (including primary backing 126 and secondary backing 124) is preferably perforated with holes or perforations 118, which may be 3–4 inches apart for example, to allow for vertical drainage.

Disposed interstitially between the upstanding turf fibers 132 upon the upper surface of turf backing 152 is an infill layer 127 of particulate matter. The infill layer 127 provides additional weight and stability for the pile fabric 150, and may assist in preventing the pile fabric 150 from moving, sliding or wrinkling over geotextile layer 122. The infill layer 127 may also operate to improve footing on the pile fabric 150, as well as providing cushioning and shock absorption. The infill layer 127 should also preferably promote or facilitate vertical drainage of water.

The particulate matter of infill layer 127 may include both hard granules or particles, such as sand, rocks or other hard particles, as well as resilient particles. The infill may include 1 layer, or may include multiple layers or courses of hard particles and/or resilient particles. Infill layer may also include 1 or more layers that include a mixture of hard and resilient particles. The resilient particles may be particles of rubber, such as butyl rubber, nitrile rubber, crumb rubber or ground tire rubber, cryogenic rubber particles, neoprene, polyethylene foam, or any other resilient particles.

According to an embodiment, ceramic support material may be used in infill layer 127. Ceramic support material may refer to material, such as clay or other material that may be formed into a shape, and then fired or heated in a kiln or other heating process. The heating process may last for a predetermined period of time or until the support material reaches a selected level of hardness, for example. Ceramic support material may be formed from a variety of different materials, including clay, Aluminum Dioxide or Alumina ($Al_2O_3$), Silicon Dioxide or Silica ($SiO_2$), a combination of Alumina and Silica (e.g., Alumina Silicate or Alumino Silicate), and other materials. For example, in some cases, Alumina and/or Silica may be present in the ceramic support material, along with other compounds or ingredients. Clay used to form ceramic support material may be made from a variety of clay materials, such as Kaolinite, which is a hydrated aluminum silicate. In some cases, ceramic support material and the like may be generally referred to as chemical stoneware, porcelain stoneware, or porcelainized stoneware.

Although the invention is not limited thereto, an example of ceramic support material which may be used in an infill layer is the support material commonly used in the petroleum refining industry. This support material used in the petroleum industry is often referred to as "inert support material," "inert support media," "catalyst support media" or simply "support media." This type of support media or ceramic support material is available in a recycled form from Crystaphase Products Inc, Houston, Tex. Such ceramic support material is also available in a new form from Petroware, Inc., Crooksville Ohio, and through its authorized distributor known as UNIVAR, Houston, Tex. Other types of ceramic support material may include "Dycat ICB Alumino-Silicate Ceramic Support," or "Katalco Dypac 99 High Density Pure Alumina Packing Media," both available from Synetix Corporation. There are several other companies which may provide or sell ceramic support media, commonly for use in the petroleum refining industry.

Ceramic support material may be provided in a wide variety of shapes and sizes, any of which may be used in an infill layer or layers. For example, ceramic support material may be provided in various shapes, such as: spheres (or balls or beads), oblong shaped, tablets, pellets (such as cylindrical shaped pellets), rectangular or square, saddle shaped and rings. A variety of sizes of ceramic support material may be used for a turf infill. For example, spheres having a diameter between 1/32 of an inch up to 1 inch may be used, where spheres having a diameter in the range of 1/8 to 1/2 of an inch may be preferred. In particular, the spheres or other shaped ceramic support materials (e.g., tablets, ovals, pellets) having a diameter or size of 1/8–1/4 inch being preferred for an infill layer. These same sizes may be used for the height and/or width dimensions of other shaped ceramic support material (such as height and width of pellets, ovals or tablets, rectangles, etc.). Spheres, pellets or tablets having a size or diameter of about 1/8 inch or 3 mm may be preferable due to their small size. These shapes and sizes of ceramic support material are provided merely by way of example, and the invention is not limited hereto.

Referring to FIG. 1 again, infill layer 127 may include two layers or courses. Infill layer 127 may include a base course 128 and a top course 130. In this example embodiment, base course 128 may be ceramic support material or substantially exclusively of ceramic support material, and may generally provide weight and stability for pile fabric 150 and prevent pile fabric 150 from moving or sliding, and may also provide some cushioning and shock absorption. The ceramic support material for base course 128 may be deposited between turf fibers 132 and upon an upper surface of the primary backing 126 using a drop spreader or other technique. The ceramic support material for base course 128 may be deposited to approximately 1/2–2 Pounds/square foot of ceramic support material, and may advantageously be deposited to approximately 1 pound/square foot, for example.

Top course 130 may be resilient particles, or substantially exclusively of resilient particles, and may be deposited using a drop spreader or other technique. Resilient particles of top course 130 primarily may provide cushioning or shock absorption. In an example embodiment, top course 130 of resilient particles may preferably be deposited to a level that is 1/4 to 1/2 an inch below the tops of turf fibers 132.

Using ceramic support material in an infill has a number of advantages over other known hard particles (such as sand, rocks, etc.). Ceramic support material includes a number of properties and advantages, including being substantially consistent in: size, shape, porosity, hardness, composition, low water absorption, void space, density, crush strength, chemical composition. In addition, the ceramic support material easily packages and ships, typically is substantially inert, typically has a high melting point (around 2500 degrees Fahrenheit in some cases). Relatively high (and consistent) weight-to-volume typically provides consistent and predictable infill performance characteristics.

The ceramic support material, having a known consistent size and shape (for a selected size and shape) may provide improved drainage because of consistent void spaces or gaps between particles when stacked in a layer(s) (e.g., allowing consistent and predictable drainage paths around particles) and substantially low porosity (or low absorption characteristics). For example, for some types of ceramic support material, such as the Katalco Dypac 99, may provide water absorption of less than about 9%, while other ceramic materials may provide water absorption of less than about 4–5%.

In some cases, with a known size of backing perforation or hole for drainage, a ceramic support material size can be selected to inhibit the support material from entering or blocking the perforations, thereby improving drainage or providing consistent drainage properties. In some cases, it may be preferable to select a ceramic support material having a size slightly larger than the backing perforation to prevent or at least inhibit such support material from entering and/or clogging the perforations.

Typically, ceramic support material is less prone to settle or pack compared to rock or sand because of its consistent shape, size and void space. In contrast, sand and rocks tend to absorb fluids and water and also may have uneven sizes and shapes, leading to unpredictable fill performance and drainage performance. In most cases, ceramic support material is not easily contaminated because of low absorption characteristics and lack of porosity.

In many cases, the ceramic support material may be substantially non-abrasive. Also, for many shapes like spheres, tablets, ovals, etc., the ceramic support material may have consistently round or smooth edges. As a result, ceramic support material in some cases may be less likely to cause damage to turf fibers or turf backing than sand or other abrasive materials. Also, ceramic support material is typically not as likely to fragment as rocks or stone because of its hardness or substantially high crush strength, and therefore the infill is less likely to degenerate or change overtime as compared to rocks, stone or other materials. For example, for a ceramic sphere of ⅛ inch diameter, at least in some cases, the crush strength of such support material has been indicated as being greater than 40 Pounds per square inch. In some cases, ceramic support material may have a crush strength in excess of about 60 Pounds per square inch. Thus, the inherent consistency (e.g., in size, shape, porosity, crush strength . . . ) for ceramic support material may allow for more precise and consistent infill performance characteristics.

In most cases, ceramic support material may be recycled and is recyclable. This is because, at least in some cases, Alumina, Silica and other materials may be recyclable, and may be available in a recycled form. Therefore, recycled ceramic support material can be used in an infill layer, which may provide less expensive infill layers and promotes re-use/recycling. While recyclable ceramic support material may be used for a turf infill, other recyclable (or recycled) support materials may advantageously be used for a turf infill layer. For example, aluminum beads or spheres or pellets or other recyclable (or recycled) support materials may be used for an infill layer. While various types of infills are described herein that may use ceramic support material, according to another embodiment, any recyclable (or recycled) support material may replace the ceramic support material in the various infill embodiments described herein. In addition support materials made from a variety of other suitable materials (i.e., other than ceramic materials), having a substantially consistent size and/or substantially consistent shape may be used in one or more of the various embodiments in place of ceramic support material.

Ceramic support materials having a substantially consistent size and shape may advantageously be used to provide a consistent void space and drainage characteristics, as noted above. For example, ceramic spheres of about 3 mm or about ⅛ inch in diameter may be used. Likewise, other particles (such as substantially hard particles) having a substantially consistent size, shape, chemical composition, etc. may similarly provide consistent infill and drainage performance.

While use of ceramic support material provides many advantages, according to one embodiment, aspects of the present invention are not limited to ceramic support material. Rather, in some cases, a wide variety of other materials, compounds, or substances (other than ceramic materials) may be used to provide support material having a substantially consistent size and shape for use as an infill. While various types of infills are described herein that may use ceramic support material, according to yet another embodiment, any support material having a substantially consistent size and shape may replace the ceramic support material in the various infill embodiments described herein.

Figure 2:
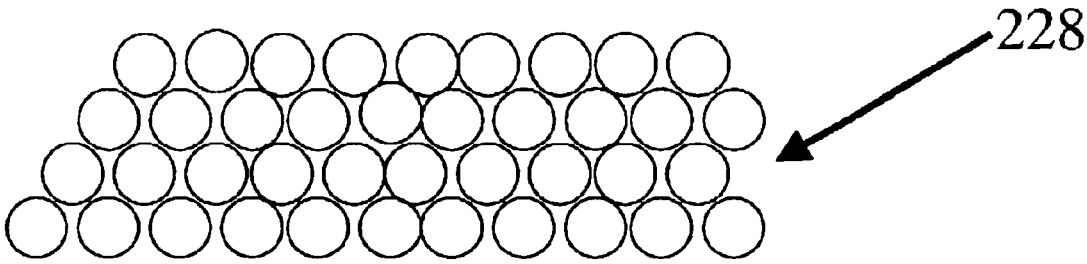
FIG. 2 is a diagram illustrating an example support material having a substantially spherical shape according to an example embodiment.

FIG. 2 is a diagram illustrating an example support material having a substantially spherical shape according to an example embodiment. Support material 228 In FIG. 2 have substantially the same size and shape. In this case, the support material 228 are substantially spherical in shape and may be piled or stacked into several rows. Support material 228 may be ceramic support material, or may be made from some other material. The support material 228 having a known and substantially consistent size and/or shape may provide improved drainage when used in an infill because of consistent void spaces or gaps between particles. These substantially consistent void spaces may allow more consistent and predictable drainage paths around and between the spheres or particles.

On the other hand, as noted above, aggregate materials such as rocks, stone and sand typically have uneven or unpredictable size and/or shape. As a result, such aggregate particles typically have uneven void spaces or gaps. Moreover, over time and as players run and fall on the turf, these stones, rocks and sand are more likely to crush, break apart or degenerate into particles having a wide variety of sizes and shapes. Thus, use of such aggregate materials in an infill may create a less predictable infill performance (including, unpredictable drainage performance).

Figure 3:
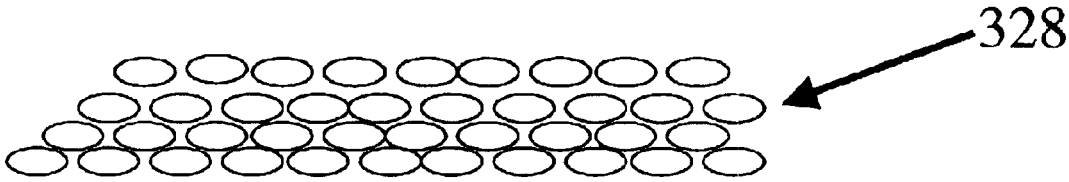
FIG. 3 is a diagram illustrating an example support material having a substantially oblong or tabular shape according to an example embodiment.

FIG. 3 is a diagram illustrating an example support material having a substantially oblong or tabular shape according to an example embodiment. Support material 328 may be ceramic support material or may be made from another type of material. Support material 328 also has a substantially consistent size and shape, and is oblong or tabular in shape. Support material 328 likewise has a substantially consistent void spaces or gaps between particles, thereby providing predictable drainage performance.

Figure 4:
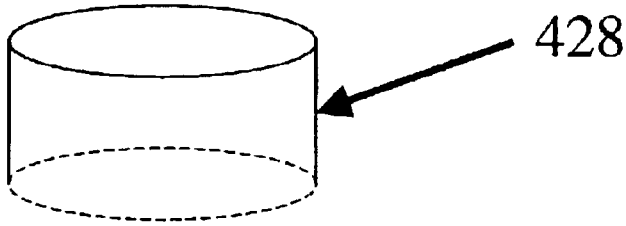
FIG. 4 is a diagram illustrating an example support material being substantially cylindrical in shape according to an example embodiment.

FIG. 4 is a diagram illustrating an example support material being substantially cylindrical in shape according to an example embodiment. Support material 428 may be considered as cylindrical in shape, or pellets. Support material 428 may be ceramic support material or may be made from another type of material.

Figure 5:
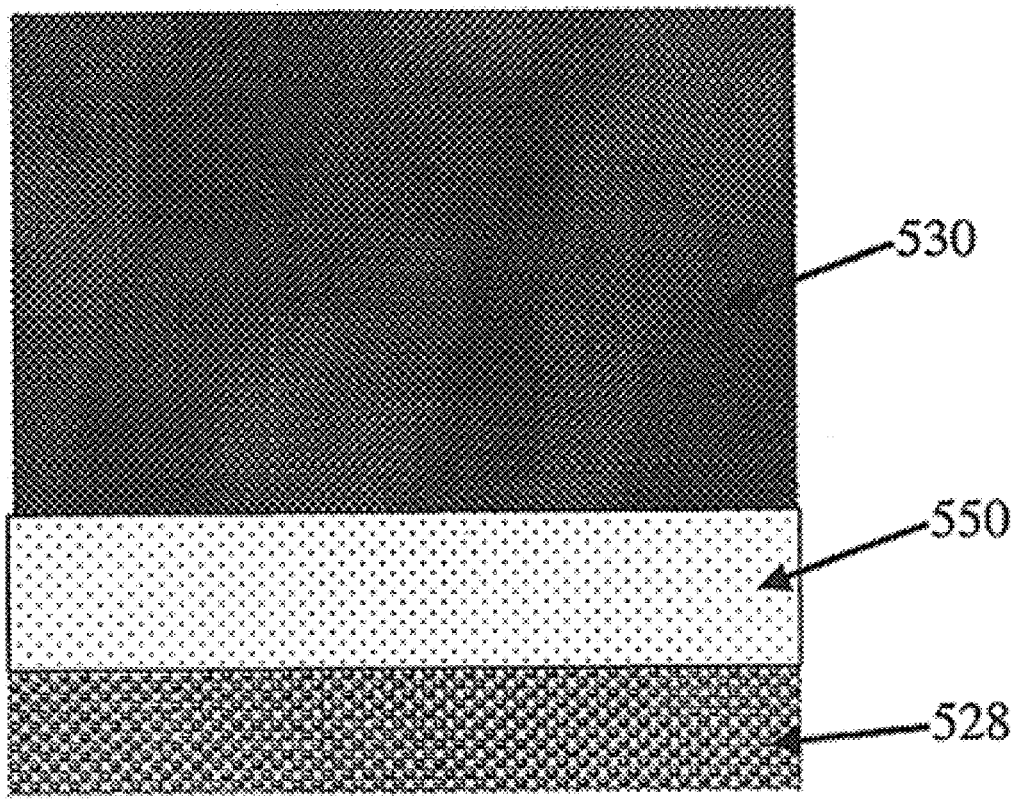
FIG. 5 is a cross-sectional view of a turf infill layer according to an example embodiment.

FIG. 5 is a cross-sectional view of a turf infill layer according to an example embodiment. Infill layer 527 may be deposited on an upper surface of primary backing 126 and interspersed between upstanding turf fibers 132 (FIG. 1). In this example embodiment, infill layer 527 may include a base course 528 of ceramic support material that is disposed on an upper surface of primary turf backing 126. The ceramic support material of base course 528 may be new or recycled, may be recyclable, and may have a substantially consistent size and shape. Base course 528 may be exclusively or substantially exclusively ceramic support material.

In FIG. 5, a middle course 550 may be disposed upon base course 528. Middle course may be, for example, rocks, stone, sand or other hard particles. Middle course 550 may be deposited using a drop spreader or other technique. Finally, a top course 530 of resilient particles (or substantially exclusively resilient particles) may be disposed on middle course 550. Thus, infill layer 527 may be a three-course infill layer using ceramic support material, sand, rocks or other hard particles, and resilient particles.

Figure 6:
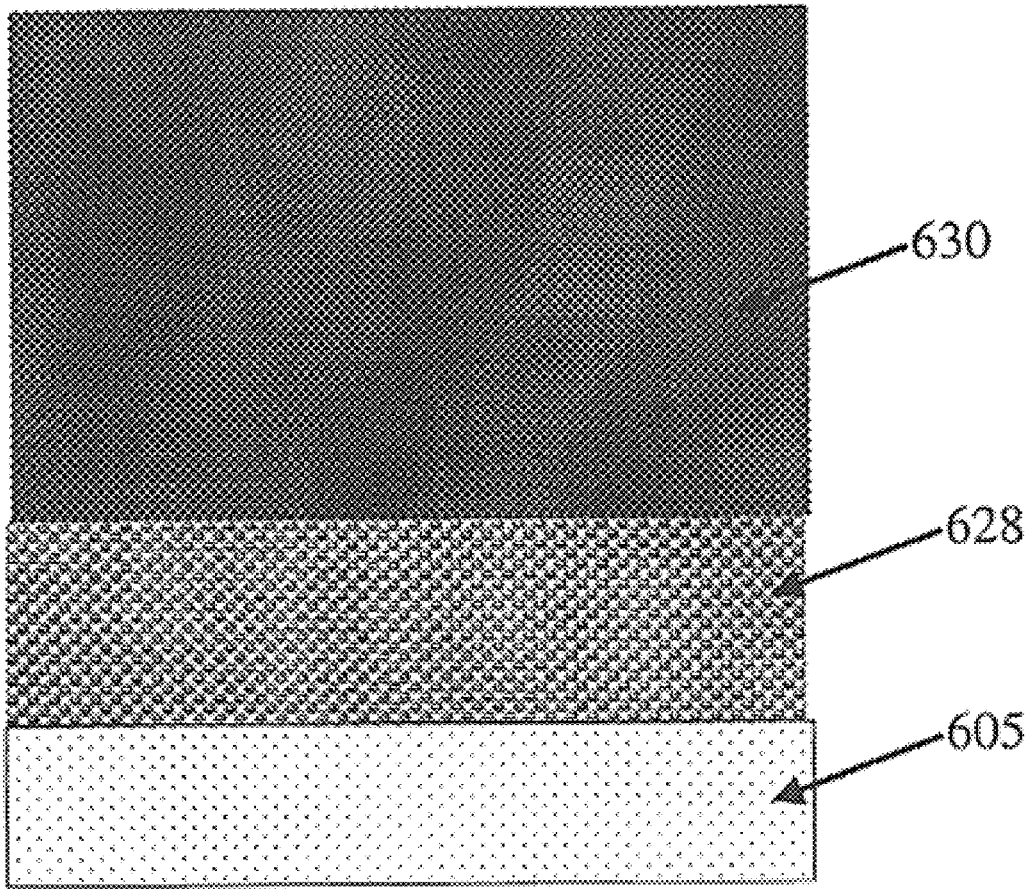
FIG. 6 is a cross-sectional view of a turf infill layer according to another example embodiment.

FIG. 6 is a cross-sectional view of a turf infill layer according to another example embodiment. Infill layer 627 may be deposited on an upper surface of primary backing 126 and interspersed between upstanding turf fibers 132 (FIG. 1). In this example embodiment, infill layer 627 may include a base course 605 of sand, rocks or other hard particles, a middle course 628 of ceramic support material (or substantially exclusively ceramic support material), and a top course 630 of resilient particles (or substantially exclusively of resilient particles). The base course 605 of sand or stone and a middle course 628 of ceramic support material may add weight and stability as well as some cushioning and shock absorption for pile fabric 150. While top course 630 of resilient particles primarily may provide cushioning or shock absorption. As indicated above, instead of using ceramic support material, middle course 628 may use another recyclable support material or other support material having a substantially consistent size and shape, as examples.

Figure 7:
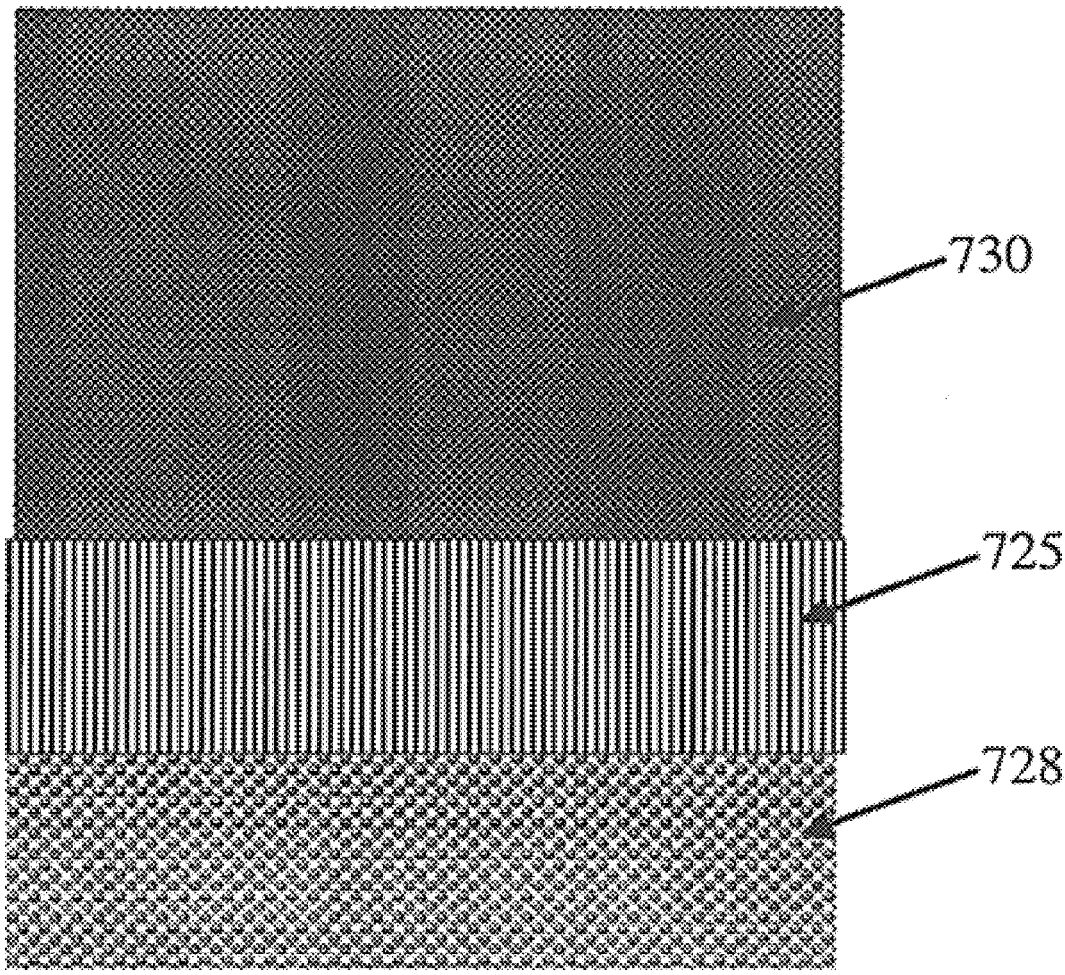
FIG. 7 is a cross-sectional view of a turf infill layer according to yet another example embodiment.

FIG. 7 is a cross-sectional view of a turf infill layer according to yet another example embodiment. Infill layer 727 may be deposited on an upper surface of primary backing 126 and interspersed between upstanding turf fibers 132 (FIG. 1). Infill layer 727 may include a base course 728 of ceramic support material (or other support material). Base course may be of substantially exclusively ceramic support material, for example. A middle course 725 may be disposed on base course 728. Middle course 725 may be a mixture of sand or rocks or stone and resilient particles. Alternatively, middle course 725 may be a mixture of ceramic support material (or other support material) and resilient particles. A top course 730 may be disposed on middle course 725. Top course 730 may be resilient particles or of substantially exclusively resilient particles.

Ceramic support material may be used in an infill layer in a wide variety of combinations. For example, different infill layers may use ceramic support material of different sizes and shapes. It may be advantageous to, for example, use a base course using ceramic support material of a first (e.g., large) size, and a top course that uses ceramic support material of a second (e.g., smaller) size. Also, different infill courses may use different shapes of ceramic support material.

For example, in an embodiment, the infill layer may include a first course of ceramic support material of a first size disposed on an upper surface of the turf backing, and a second course of ceramic support material of a second size disposed on the first course. The second size may different from the first size. For example, ceramic support material used in a base course may be larger than the support material used in an upper course or a top course. This may allow finer levels of granularity to be placed near the top of a layer or infill layer (e.g., nearest the point of contact with players). An additional layer or course of resilient particles may be disposed over such courses of ceramic support material.

In another embodiment, the infill layer may include a first course (e.g., base course) of ceramic support material of a first size disposed on an upper surface of the turf backing, and a second course (e.g., top course) of ceramic support material of a second size that is smaller than the first size. Alternatively, the support material in the second or top course may be larger than the support material in the first or base course. The second course is disposed on the first course. The infill layer may include a third course of resilient particles disposed on the second course.

In another embodiment, the infill layer may include a base course of ceramic support material of a first size disposed on an upper surface of the turf backing. The infill layer also includes a middle course of ceramic support material of a second size disposed on the base course. And, a top course of ceramic support material of a third size, the top course being disposed on the middle course. According to an embodiment, the first size may be larger than the second size, and the second size may be larger than the third size. Alternatively, the third size may be larger than the second size, and the second size may be larger than the first size.

In yet another embodiment, an infill layer may comprise a base course of intermixed ceramic support material of a first size and resilient particles. The base course is disposed on an upper surface of the turf backing., The infill layer may also include a top course of intermixed ceramic support material of a second size and resilient particles, the top course being disposed on the base course. Also, in an embodiment, the second size may be different from the first size. In one embodiment, the second size is smaller than the first In an embodiment, the infill layer may comprise a first course of ceramic support material of a first shape, the first course being disposed on an upper surface of the turf backing. The infill layer may also include a second course of ceramic support material of a second shape that is different from the first shape, the second course being disposed on the first course. A third (e.g., upper) course of resilient particles may also be disposed on the second course.

In yet another embodiment, the infill layer may include a first course of ceramic support material of a first shape and a first size, the first course disposed on an upper surface of the turf backing. The infill layer may also include a second course of ceramic support material of a second shape and a second size, the second size and shape being different from the first size and shape, respectively, and the second course being disposed on the first course. A third course (e.g., top course) may also be disposed on the second course.

Figure 8:
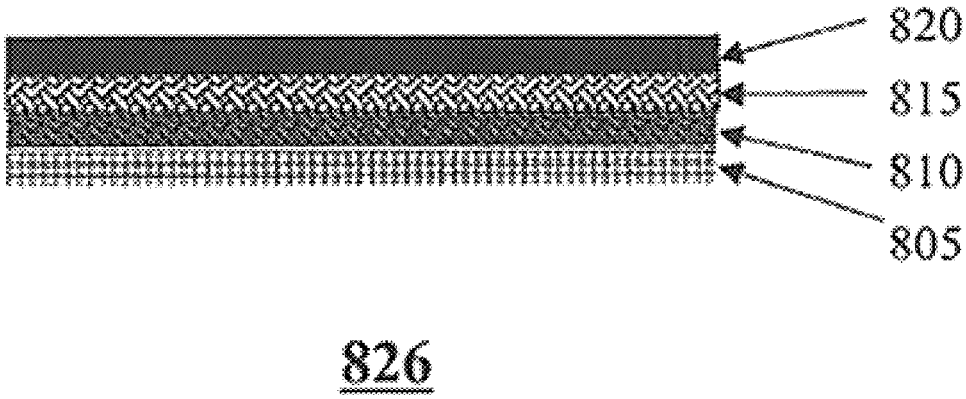
FIG. 8 is a cross-sectional view of a quad-layer primary backing according to an example embodiment.

FIG. 8 is a cross-sectional view of a quad-layer (or four-layer) primary backing according to an example embodiment. Referring to FIG. 8, primary backing 826 may include up to four layers, for example. Primary backing 826 may include a first layer 805 which may be a non-woven layer. Layer 805 may be, for example, a plastic grid type material. The grid may be rectangular in shape, or any other grid shape, such as diamond-shaped grids, etc.

Alternatively, layer 805 may be, for example, an Actionbac material available from BP Fabrics and Fibers, Austell, Georgia. Layer 805 may be, for example, 4–5 PIC. PIC is a term that may indicate the weight of the fabric. Alternatively, layer 805 may be a woven polypropylene fabric, which in some cases, may also be known as an Actionbac. Thus, first layer 805 may be woven or non-woven. As noted above, a urethane secondary backing 124 may be applied to first layer 805.

Primary backing 826 next may include a second layer over 810 or on top of first layer 805. Second layer 810 preferably be a woven material, such as a 6 PIC woven material. Next, a third layer 815 may be provided over second layer 810. Third layer 815 may be a woven fabric of, for example, 10 PIC fabric. A variety of woven materials or fabrics may be used for layers 810 and 815, such as polyester, nylon, or a polyester/nylon blend. Other materials can be used. Layers 810 and 815 may add weight, integrity and strength to the pile fabric. Alternatively, layers 810 and 815 may be non-woven.

Next, primary backing 826 may include a fourth layer 820 provided over third layer 815. Fourth layer 820 be a woven or non-woven material. In an example embodiment, fourth layer 820 be a non-woven Colbond material. In one example embodiment, layer 820 be a FLW layer or a felt material. In another example embodiment, layer 820 include a layer of FLW cloth, which may be a woven synthetic fabric in some cases.

In an example embodiment, two or more of the various layers of primary backing 826 may be stitched together or otherwise connected together. Also, the tufting of turf fibers through primary backing 826 may also function to keep the various layers 805–820 together.

While a particular order or arrangement for layers 805–820 is shown and described with reference to FIG. 8, according to an embodiment, these four layers may be provided in any order. In another embodiment, primary backing may include any three of these four layers shown, in any order.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. An artificial turf system comprising:

a pile fabric having a turf backing and a plurality of turf fibers extending upwardly from the turf backing;

an infill layer of particulate material disposed between the turf fibers upon an upper surface of the turf backing, the infill layer comprising:

a base course of ceramic support material disposed on an upper surface of the turf backing;

a middle course of sand, rocks or other hard particles disposed on the base course; and a top course of resilient particles disposed on the middle course.

2. An artificial turf system comprising:

a pile fabric having a turf backing and a plurality of turf fibers extending upwardly from the turf backing;

an infill layer of particulate material disposed between the turf fibers upon an upper surface of the turf backing, the infill layer comprising:

a base course of ceramic support material disposed on an upper surface of the turf backing;

a middle course of intermixed ceramic support material and resilient particles disposed on the base course; and a top course of resilient particles disposed on the middle course.

3. An artificial turf system comprising:

a pile fabric having a turf backing and a plurality of turf fibers extending upwardly from the turf backing;

an infill layer of particulate material disposed between the turf fibers upon an upper surface of the turf backing, the infill layer comprising:

a first course of ceramic support material of a first size disposed on an upper surface of the turf backing; and a second course of ceramic support material of a second size, the second course disposed on said first course, the second size being different from the first size.

4. The artificial turf system of claim 3, wherein the second size is smaller than the first size.

5.The artificial turf system of claim 3, and further comprising a third course of resilient particles disposed on said second course.

6. An artificial turf system comprising:

a pile fabric having a turf backing and a plurality of turf fibers extending upwardly from the turf backing;

an infill layer of particulate material disposed between the turf fibers upon an upper surface of the turf backing, the infill layer comprising:

a base course of ceramic support material of a first size disposed on an upper surface of the turf backing; and a middle course of ceramic support material of a second size, the middle course disposed on said base course; and a top course of ceramic support material of a third size, the top course disposed on said middle course.

7. The artificial turf system of claim 6 wherein said first size is larger than the second size and the second size is larger than the third size.

8. An artificial turf system comprising:

a pile fabric having a turf backing and a plurality of turf fibers extending upwardly from the turf backing;

an infill layer of particulate material disposed between the turf fibers upon an upper surface of the turf backing, the infill layer comprising:

a base course of intermixed ceramic support material of a first size and resilient particles, the base course disposed on an upper surface of the turf backing; and a top course of intermixed ceramic support material of a second size and resilient particles, the top course disposed on said base course, the second size being different from the first size.

9. The artificial turf system of claim 8 wherein the second size is smaller than the first size.

10. An artificial turf system comprising:

a pile fabric having a turf backing and a plurality of turf fibers extending upwardly from the turf backing;

an infill layer of particulate material disposed between the turf fibers upon an upper surface of the turf backing, the infill layer comprising:

a first course of ceramic support material of a first shape, the first course disposed on an upper surface of the turf backing; and a second course of ceramic support material of a second shape that is different from the first shape, the second course disposed on the first course.

11. The artificial turf system of claim 10 and further comprising a third course of resilient particles disposed on the second course.

12. An artificial turf system comprising:

a pile fabric having a turf backing and a plurality of turf fibers extending upwardly from the turf backing;

an infill layer of particulate material disposed between the turf fibers upon an upper surface of the turf backing, the infill layer comprising:

a first course of ceramic support material of a first shape and a first size, the first course disposed on an upper surface of the turf backing; and a second course of ceramic support material of a second shape and a second size, the second size and shape being different from the first size and shape, respectively, and the second course disposed on the first course.

13. The artificial turf system of claim 12, and further comprising a third course of resilient particles disposed on the second course.

14. A method of forming an artificial turf system comprising;

providing a pile fabric over an aggregate layer, the pile fabric having a turf backing and a plurality of turf fibers extending upwardly from the turf backing; and providing an infill of particulate material disposed upon an upper surface of the turf backing and between the turf fibers, wherein said providing an infill layer comprises:

providing a first course of ceramic support material of a first size disposed on an upper surface of the turf backing; and providing a second course of ceramic support material of a second size, the second course being disposed on said first course, the second size being different from the first size.

15. A method of forming an artificial turf system comprising:

providing a pile fabric over an aggregate layer, the pile fabric having a turf backing and a plurality of turf fibers extending upwardly from the turf backing; and providing an infill of particulate material disposed upon an upper surface of the turf backing and between the turf fibers, wherein said providing an infill layer comprises:

providing a first course of ceramic support material having a first shape disposed on an upper surface of the turf backing; and providing a second course of ceramic support material having a second shape, the second course disposed on said first course, the second shape being different from the first shape.

* * * * *